US007775621B2

(12) United States Patent
Chun

(10) Patent No.: US 7,775,621 B2
(45) Date of Patent: Aug. 17, 2010

(54) INK JET HEAD CLEANING DEVICE AND INK JET IMAGE FORMING APPARATUS HAVING THE SAME

(75) Inventor: Jee Hoon Chun, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 315 days.

(21) Appl. No.: 12/056,348

(22) Filed: Mar. 27, 2008

(65) Prior Publication Data

US 2008/0297557 A1 Dec. 4, 2008

(30) Foreign Application Priority Data

May 28, 2007 (KR) ..... 10-2007-0051377

(51) Int. Cl.
*B41J 2/165* (2006.01)

(52) U.S. Cl. ..... 347/21; 347/22; 347/32

(58) Field of Classification Search ..... 347/21, 347/22, 27, 29, 32, 35, 39
See application file for complete search history.

(56) References Cited

U.S. PATENT DOCUMENTS

| | | | | |
|---|---|---|---|---|
| 7,086,716 | B2 * | 8/2006 | Steinfield et al. | 347/32 |
| 7,270,393 | B2 * | 9/2007 | Berry et al. | 347/29 |
| 2008/0316251 | A1 * | 12/2008 | Heo | 347/28 |

FOREIGN PATENT DOCUMENTS

| | | |
|---|---|---|
| CN | 1953872 | 4/2007 |
| CN | 1962269 | 5/2007 |
| KR | 2003-31247 | 4/2003 |

OTHER PUBLICATIONS

Chinese Office Action issued Dec. 4, 2009 in CN Application No. 2008101428463.

* cited by examiner

*Primary Examiner*—Lamson D Nguyen
(74) *Attorney, Agent, or Firm*—Stanzione & Kim LLP

(57) ABSTRACT

A print head cleaning device, an ink jet image forming apparatus having the same, and methods thereof include a cleaning liquid circulation and/or a structure to clean an image forming apparatus print head.

21 Claims, 9 Drawing Sheets

INK JET HEAD CLEANING DEVICE AND INK JET IMAGE FORMING APPARATUS HAVING THE SAME

CROSS-REFERENCE TO RELATED APPLICATIONS

This application claims priority under 35 U.S.C. §119(a) from Korean Patent Application No. 2007-0051377, filed on May 28, 2007 in the Korean Intellectual Property Office, the disclosure of which is incorporated herein by reference.

BACKGROUND OF THE INVENTION

1. Field of the Invention

The present general inventive concept relates to an ink jet image forming apparatus, and more particularly, to an ink jet image forming apparatus having a cleaning device to clean an ink jet head.

2. Description of the Related Art

An ink jet image forming apparatus is an apparatus that forms an image by ejecting ink onto a printing medium. According to a printing type, the ink jet image forming apparatus is classified as a shuttle type or a line printing type. The shuttle type ink jet image forming apparatus forms an image by using an ink jet head that can move reciprocally in a direction perpendicular to a feeding direction of a printing medium. The line printing type ink jet image forming apparatus forms an image by using an array ink jet head which is provided with a nozzle part having a length corresponding to a width of a printing medium.

Regardless of the shuttle type or the line printing type, in order for the ink jet image forming apparatus to print an image of a good quality, a nozzle part of the ink jet head should be kept in a desirable state or an optimum state for printing. For this, the ink jet image forming apparatus is provided with a maintenance device to keep the nozzle part of the ink jet head in a good condition. The maintenance device generally performs maintenance operations, such as spitting, wiping and capping. The spitting is to eject the ink several times at a regular cycle to remove the ink whose viscosity becomes high. The wiping is to wipe off foreign substances from the nozzle part. The capping is to cap the nozzle part to shield the same from outdoor air.

Through the above maintenance operations, the nozzle part of the ink jet image forming apparatus can be kept in a good condition. However, in some cases, the nozzle is blocked (e.g., severely) so that it cannot be easily recovered. To address this problem, there is an ink jet image forming apparatus that is provided with a cleaning device using ultrasonic waves as the maintenance device.

An example of the ink jet image forming apparatus having a cleaning device using ultrasonic waves is disclosed in Korean Patent Publication No. 10-2003-0031247. The disclosed cleaning device is one that is applied to the shuttle type ink jet image forming apparatus. The cleaning device includes a storage tank in which a cleaning liquid is stored, a cleaning bath that is mounted above the storage tank, and a cleaning liquid supply pump to supply the cleaning liquid in the storage tank to the cleaning bath. The cleaning bath is formed with a cleaning liquid supply/drain hole to supply and drain the cleaning liquid, and a cleaning liquid exhaust hole to maintain a water level in the cleaning bath constant. If the cleaning liquid supply pump operates in a cleaning mode, the cleaning liquid is supplied into the cleaning bath through the cleaning liquid supply/drain hole, and an ultrasonic element disposed on a bottom of the cleaning bath oscillates to clean the ink jet head. If the cleaning mode is terminated, the cleaning liquid in the cleaning bath is collected into the storage tank by its own weight.

However, the above conventional cleaning device has various disadvantages such as the cleaning liquid cannot be totally collected and can remain in the cleaning bath or flow passage because the cleaning liquid in the cleaning bath is collected only by its own weight. If the cleaning liquid remains in the cleaning bath, it may have a bad influence on electrical components mounted around the cleaning bath. If the cleaning liquid remains in the flow passage through which cleaning water circulates, foreign substances may be accumulated in the flow passage so that the flow passage becomes narrowed or clogged.

Further, the disclosed cleaning device is not adequate to clean an array ink jet head having a wide width because the cleaning device is fixed to a specific position in the shuttle type ink jet image forming apparatus.

SUMMARY OF THE INVENTION

The present general inventive concept provides an ink jet head cleaning device and an ink jet image forming apparatus having the same with a cleaning liquid circulation structure to securely collect a cleaning liquid in a cleaning liquid passage.

The present general inventive concept provides an ink jet head cleaning device, an ink jet image forming apparatus having the same and methods thereof that can clean an array ink jet head.

The present general inventive concept provides a print head cleaning device, an image forming apparatus having the same, and methods thereof that can provide a cleaning liquid circulation and/or a structure to clean an image forming apparatus print head.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept may be achieved by providing an ink jet image forming apparatus including an ink jet head, and a cleaning device to clean the ink jet head, the cleaning device including: a storage tank to store a cleaning liquid, a cleaning bath that is supplied with the cleaning liquid from the storage tank and in which an oscillating element is mounted, an outer bath to accommodate the cleaning liquid flowing over the cleaning bath, a first cleaning liquid passage to connect the storage tank and the cleaning bath, a second cleaning liquid passage to connect the outer bath and the storage tank, a first pumping part provided in the first cleaning liquid passage, and a second pumping part provided in the second cleaning liquid passage.

The first pumping part is configured to be capable of bidirectional pumping.

The cleaning device further may include an auxiliary tank mounted in the first cleaning liquid passage to store the cleaning liquid pumped from the storage tank.

The first pumping part and the second pumping part may be driven by one pumping motor.

The second cleaning liquid passage may have a cleaning liquid return hole connected with the storage tank at a position higher than an uppermost level of the cleaning liquid stored in the storage tank.

The second cleaning liquid passage may have a cleaning liquid drain hole connected with the outer bath at a position adjacent to a bottom surface of the outer bath.

The storage tank may have an atmosphere communication hole to be kept at an atmospheric pressure.

The first cleaning liquid passage may have a first auxiliary tank connecting hole and a second auxiliary tank connecting hole to communicate with the auxiliary tank. The first auxiliary tank connecting hole may communicate with the auxiliary tank at a position adjacent to a bottom surface of the auxiliary tank, and the second auxiliary tank connecting hole may communicate with the auxiliary tank at a position adjacent to a top surface of the auxiliary tank so that the cleaning liquid pumped from the storage tank can be supplied to the cleaning bath after filling up the auxiliary tank.

The ink jet head may be configured as an array ink jet head that has a nozzle part having a length corresponding to a width of a printing medium.

The first cleaning liquid passage and the second cleaning liquid passage may be a flexible material, and the cleaning bath and the outer bath may mount movably along a width direction of the array ink jet head.

The ink jet image forming apparatus further may include a control unit to control operations of the first pumping part and the second pumping part. The control unit performs a cleaning mode to control the first pumping part and the second pumping part to pump the cleaning liquid in a first direction to supply the cleaning liquid in the storage tank to the cleaning bath and collect the cleaning liquid in the outer bath into the storage tank.

The control unit may perform a first cleaning liquid collecting mode to control the first pumping part and the second pumping part to pump the cleaning liquid in a second direction to collect the cleaning liquid in the cleaning bath into the storage tank and send the cleaning liquid in the second cleaning liquid passage into the outer bath.

The control unit may perform a second cleaning liquid collecting mode to control the first pumping part and the second pumping part to pump the cleaning liquid in the first direction to collect the cleaning liquid in the outer bath into the storage tank.

The control unit may perform a third cleaning liquid collecting mode to control the first pumping part and the second pumping part to pump the cleaning liquid in the second direction to collect the cleaning liquid in the first cleaning liquid passage into the storage tank.

The foregoing and/or other aspects and utilities of the present general inventive concept may also be achieved by providing an ink jet head cleaning device including a storage tank to store a cleaning liquid, a cleaning bath that has an opened upper portion and in which an oscillating element is mounted, an outer bath to accommodate the cleaning liquid flowing over the cleaning bath, a first cleaning liquid passage to connect the storage tank and the cleaning bath and has a cleaning liquid storage part to store the cleaning liquid supplied from the storage tank, a second cleaning liquid passage to connect the outer bath and the storage tank, a pump mounted in the first cleaning liquid passage and the second cleaning liquid passage and capable of bidirectional pumping, and a control unit to control an operation of the pump.

The cleaning liquid storage part may be provided with an auxiliary tank mounted in the first cleaning liquid passage.

The control unit may perform a cleaning mode to control the pump to pump the cleaning liquid in a first direction to circulate the cleaning liquid in the storage tank through the first cleaning liquid passage, the cleaning bath, the outer bath and the second cleaning liquid passage.

The control unit may perform a first cleaning liquid collecting mode to control the pump to pump the cleaning liquid in a second direction to collect the cleaning liquid in the cleaning bath and the first cleaning liquid passage into the storage tank and send the cleaning liquid in the second cleaning liquid passage into the outer bath.

The control unit may perform a second cleaning liquid collecting mode to control the pump to pump the cleaning liquid in the first direction to collect the cleaning liquid in the outer bath into the storage tank and send the cleaning liquid in the storage tank into the cleaning liquid storage part.

The control unit may perform a third cleaning liquid collecting mode to control the pump to pump the cleaning liquid in the second direction to collect the cleaning liquid in the cleaning liquid storage part into the storage tank.

The foregoing and/or other aspects and utilities of the present general inventive concept may also be achieved by providing an ink jet head cleaning device usable with an image forming apparatus including a storage tank to store a cleaning liquid, a bath having an oscillating element to generate a liquid stream from the cleaning liquid, and a pump connected between the storage tank and the bath to circulate the cleaning liquid between the storage bath and the storage tank.

The ink jet head cleaning device may include of a first passage having first ends coupled to the storage tank and the bath, and a second passage having second ends coupled to the storage tank and the bath.

The ink jet head cleaning device may include at least one of the first ends and the second ends is disposed above the oscillating element.

The ink jet head cleaning device may perform the pump pumps the cleaning liquid in a first direction between storage unit to the bath and in a second direction between the storage unit and the bath.

The ink jet head cleaning device may be that the pump is located higher than the storage tank and lower than the bath.

The foregoing and/or other aspects and utilities of the present general inventive concept may also be achieved by providing an image forming apparatus, including an inkjet head, and an inkjet head having device to clean the inkjet head, including a storage tank to store a cleaning liquid, a bath having an oscillating element to generate a liquid stream from the cleaning liquid, and a pump connected between the storage tank and the bath to circulate the cleaning liquid between the storage bath and the storage tank.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF EMBODIMENTS

Figure 1:
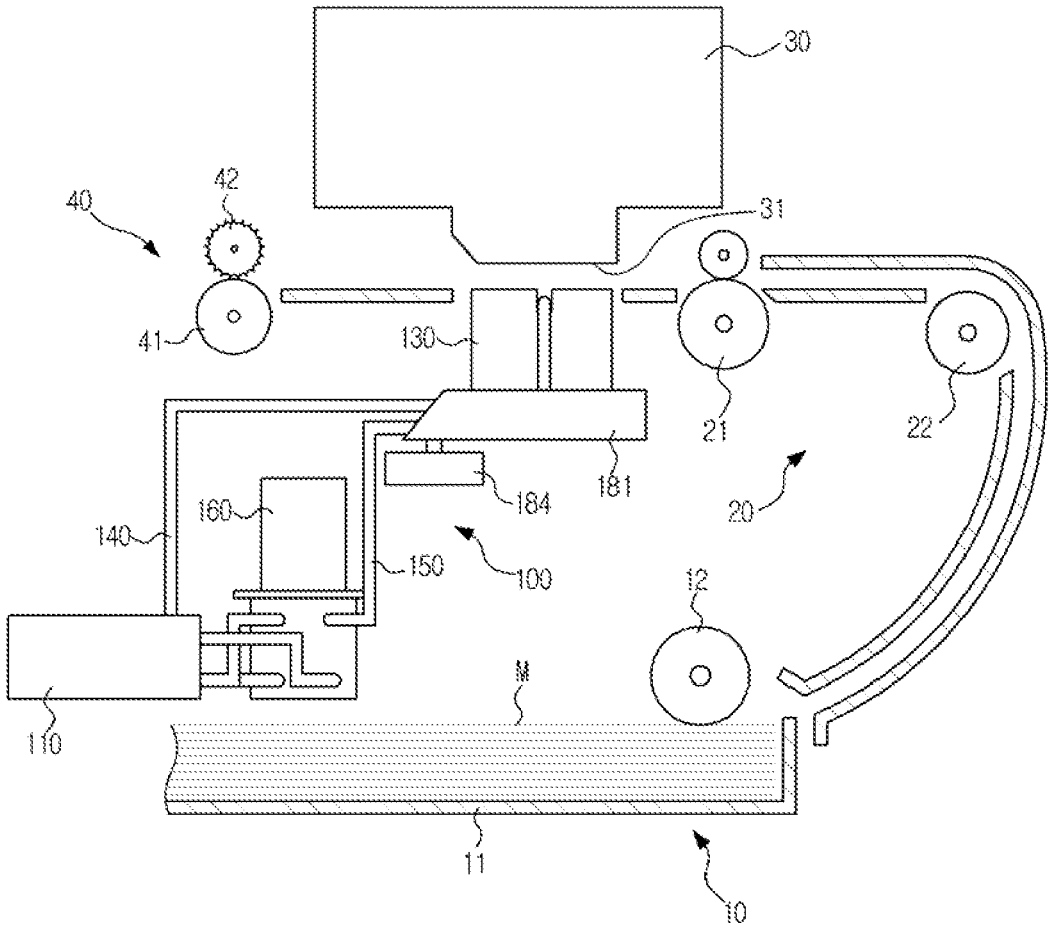
FIG. 1 is a diagram illustrating an ink jet image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a diagram illustrating a constitution of an ink jet image forming apparatus in accordance with an embodiment of the present general inventive concept.

As illustrated in FIG. 1, the ink jet image forming apparatus according to the present general inventive concept includes a paper supply unit 10 to supply a printing medium M, a feeding unit 20 to feed the printing medium, an ink jet head 30 to form an image on the printing medium (e.g., fed by the feeding unit 20), and a discharge unit 40 to discharge the printing medium, which preferably has an image printed thereon, to the outside of the image forming apparatus.

The paper supply unit 10 includes a paper supply tray 11 on which the printing medium M is loaded, and a pick up roller 12 to pick up the printing medium loaded on the paper supply tray 11 sheet by sheet. The feeding unit 20 feeds the printing medium picked up by the pickup roller 12 to an area below the ink jet head 30, and can include a feeding roller 21 mounted near an inlet of the ink jet head 30, and an auxiliary roller 22 mounted between the feeding roller 21 and the pickup roller 12.

Figure 2:
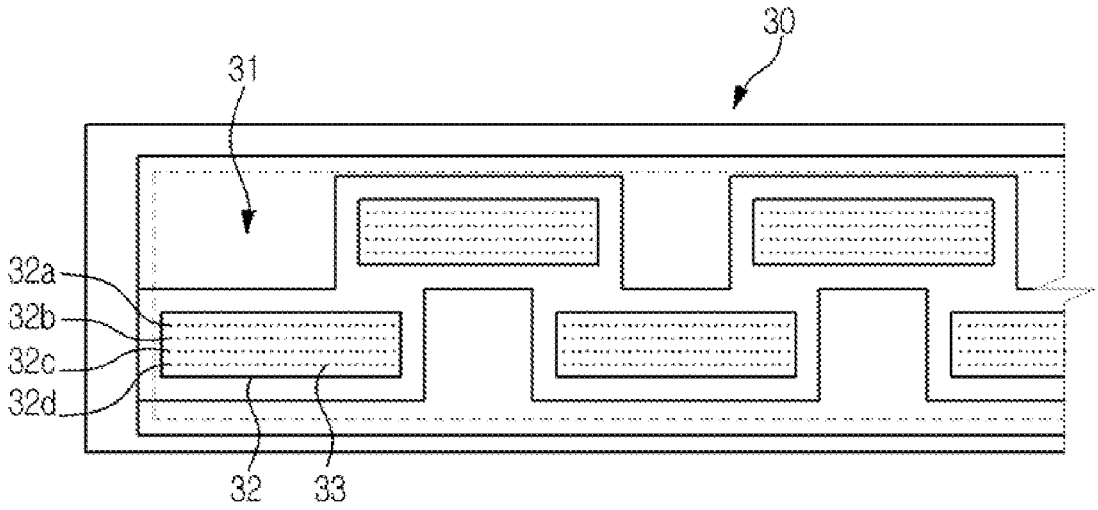
FIG. 2 is a diagram illustrating a nozzle part of an ink jet head in the ink jet image forming apparatus of FIG. 1.

In the embodiment of FIG. 1, the ink jet head 30 is configured as an array ink jet head which is provided with a nozzle part 31 having a length corresponding to a width of the printing medium that is, a length in a widthwise direction of the printing medium and perpendicular to a feeding direction of the printing medium. Such an ink jet head 30 is configured to print an image by ejecting the ink onto the printing medium M at a fixed position. FIG. 2 is a diagram illustrating an exemplary configuration of the nozzle part 31 of the ink jet head 30 in the ink jet image forming apparatus of FIG. 1. As illustrated in FIGS. 1 and 2, the nozzle part 31 is provided with a plurality of nozzle plates 32 that can be arranged in a zigzag shape in a width direction of the nozzle part 31. Each of the nozzle plates 32 is formed with a plurality of nozzles 33 through which the ink is ejected. Each nozzle plate 32 may be provided with a plurality of nozzle rows 32*a*, 32*b*, 32*c* and 32*d*. The respective nozzle rows 32*a*, 32*b*, 32*c* and 32*d* can eject the ink of the same color or different colors (e.g., cyan, magenta, yellow and black).

The discharge unit 40 includes a discharge roller 41 mounted in the downstream side of the ink jet head 30 with respect to the feeding direction of the printing medium M, and a star wheel 42 mounted opposite to the discharge roller 41. The star wheel 42 can function to prevent (e.g., reduce the likelihood) the printing medium M passing below the nozzle part 31 from contacting the nozzle part 31, or prevent a gap between the printing medium M and the nozzle part 31 from being changed.

Figure 3:
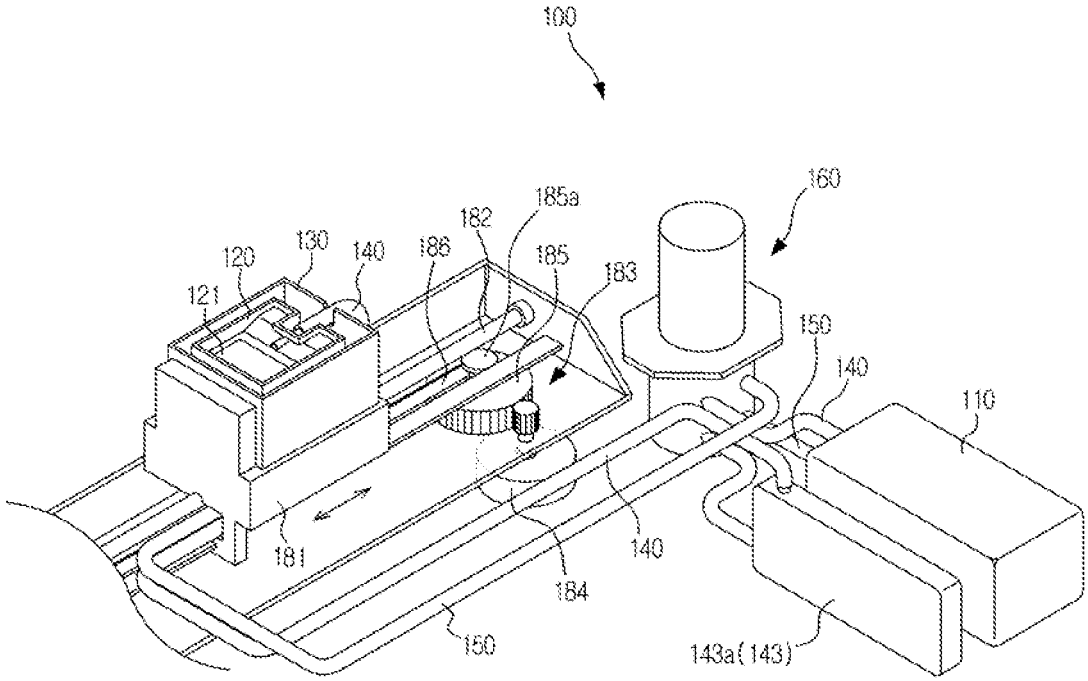
FIG. 3 is a perspective view illustrating an ink jet head cleaning device in accordance with an embodiment of the present general inventive concept.
Figure 4:
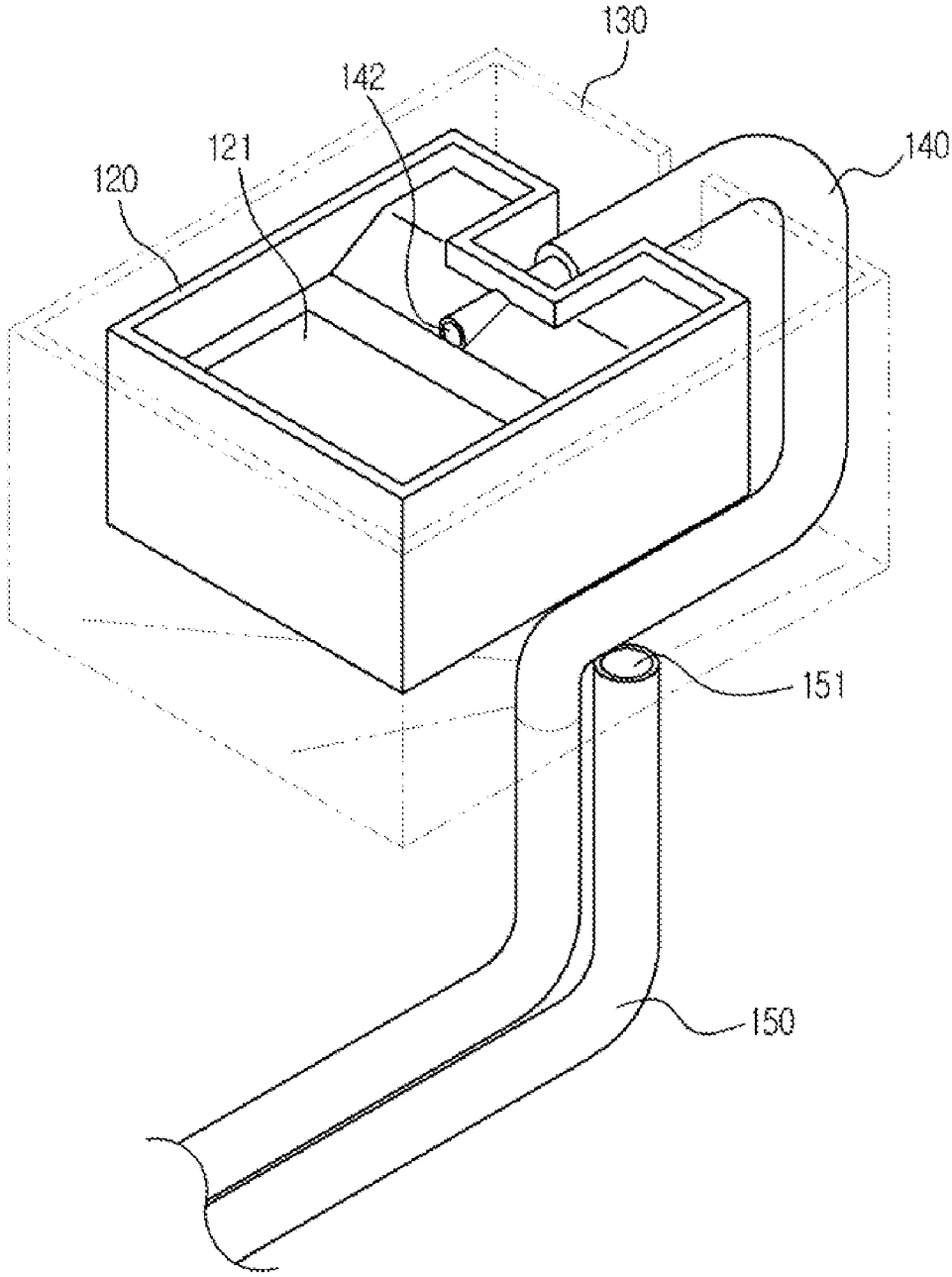
FIG. 4 is a perspective view illustrating a cleaning bath and an outer bath of the ink jet head cleaning device of FIG. 3.
Figure 5:
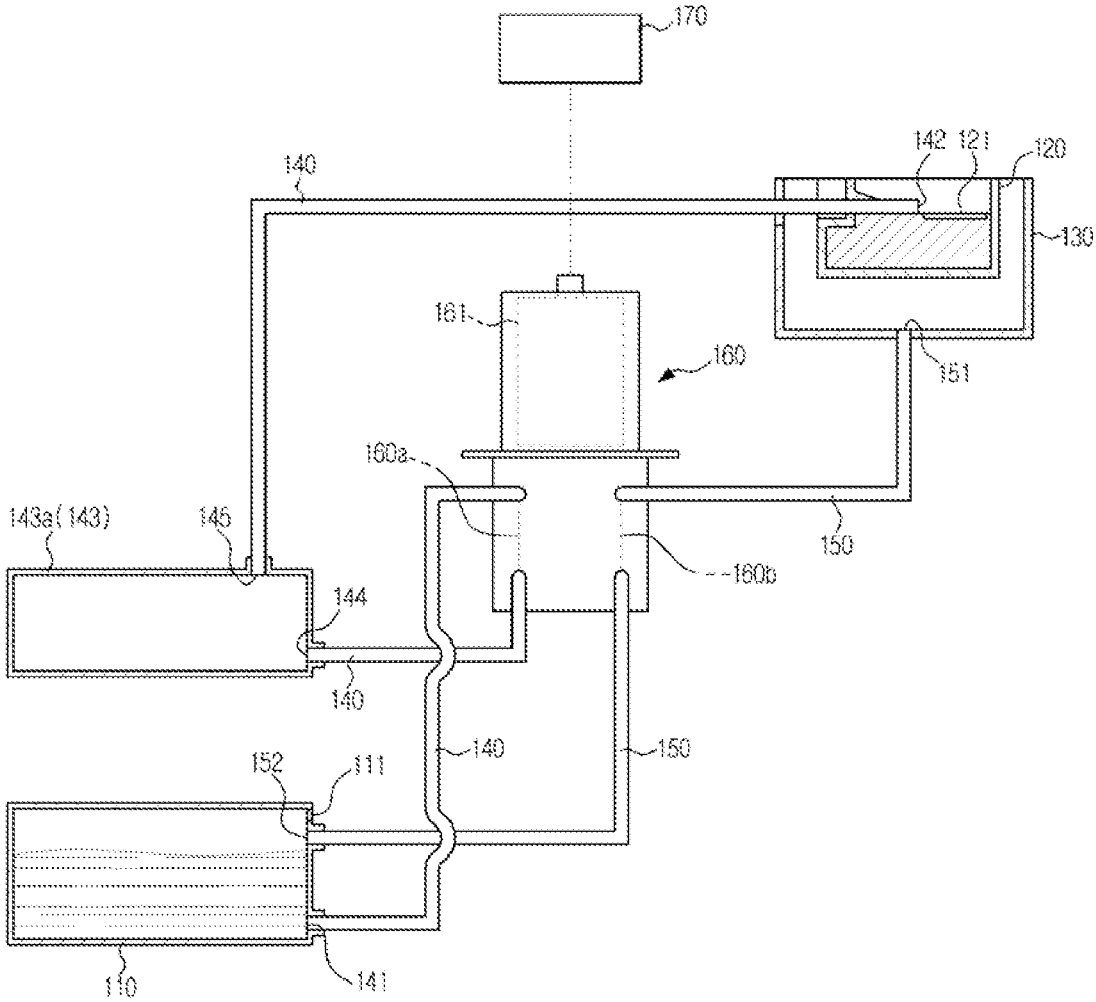
FIG. 5 is a view illustrating an exemplary constitution of an ink jet head cleaning device in accordance with an embodiment of the present general inventive concept.

FIG. 3 is a perspective view illustrating an embodiment of an ink jet head cleaning device in accordance with the present general inventive concept, FIG. 4 is a perspective view illustrating a cleaning bath and an outer bath of the ink jet head cleaning device of FIG. 3, and FIG. 5 is a diagram conceptually illustrating the constitution of the ink jet head cleaning device in accordance with FIG. 3.

As illustrated in FIGS. 1 through 5, the ink jet image forming apparatus further includes a cleaning device (inkjet head cleaning device) 100 to clean the ink jet head 30. The cleaning device 100 may clean the nozzle part 31 of the ink jet head 30 with a cleaning liquid. The cleaning liquid may remove foreign substances, such as ink residue, paper dust or the like, which can block the nozzles 33.

The cleaning device 100 may include a storage tank 110 in which a cleaning liquid is stored, a cleaning bath 120 (e.g., disposed below the ink jet head 30) in which an ultrasonic oscillating element 121 may be mounted, an outer bath 130 to house or surround the cleaning bath 120, a first cleaning liquid passage 140 to connect the storage tank 110 and the cleaning bath 120, a second cleaning liquid passage 150 to connect the outer bath 130 and the storage tank 110, a device such as a pump 160 to forcibly circulate the cleaning liquid, and a control unit 170 (refer to FIG. 5) to control at least an operation of the pump 160.

The cleaning bath 120 and the outer bath 130 are mounted movably along the lengthwise direction of the ink jet head 30 corresponding to a widthwise direction of the printing medium and a perpendicular direction to a feeding direction of the printing medium. The ink jet head cleaning device 100 may further include a storage position different than a cleaning position. For example, the cleaning device 100 may include a carriage 181 on which the cleaning bath 120 and the outer bath 130 are mounted, a carriage shaft 182 to guide the movement of the carriage 181, and a carriage driving unit 183 that may move the carriage 181 reciprocally (e.g., left and right) along the carriage shaft 182. The carriage driving unit 183 may include a carriage driving motor 184, a gear 185 to transmit power of the driving motor 184, and a carriage driving belt 186 that may circulate while engaged with a small gear part 185*a* of the gear 185 and transmit power of the driving motor 184 to the carriage 181.

As illustrated in FIG. 5, the cleaning liquid is stored in the storage tank 110, and the storage tank 110 is provided with an atmosphere communication hole 111 at one side, which communicates with the atmosphere. The atmosphere communication hole 111 connects the interior and the exterior of the storage tank 110 so that the interior of the storage tank 110 is kept at an atmospheric pressure when the amount of cleaning liquid stored in the storage tank 110 is changed as the cleaning liquid circulates.

The cleaning bath 120 is supplied with the cleaning liquid from the storage tank 110 through the first cleaning liquid passage 140. The first cleaning liquid passage 140 has a storage tank connecting hole 141, which communicates with the storage tank 110, and a cleaning liquid flow hole 142, which communicates with the cleaning bath 120. The storage tank connecting hole 141 communicates with a lower portion of the storage tank 110 to be always immersed in the cleaning liquid stored in the storage tank 110. The cleaning liquid flow hole 142 is positioned adjacent to a bottom of the cleaning bath 120, so that when collecting the cleaning liquid from the cleaning bath 120 through the cleaning liquid flow hole 142, all possible cleaning liquid can be collected without remaining in the cleaning bath 120.

An upper surface of the cleaning bath 120 is open, and configured to oppose the nozzle part 31 of the ink jet head 30. The ultrasonic oscillating element 121 may be mounted on the bottom of the cleaning bath 120. The ultrasonic oscillating element 121 may be used as a piezoceramic transducer. If electric current is applied to the ultrasonic oscillating element 121 when the cleaning liquid has been supplied into the cleaning bath 120, the ultrasonic oscillating element 121 can oscillate ultrasonic waves, and accordingly, a water column may be formed on the surface of the cleaning liquid (or drops, splashes of the like) to clean the nozzle part 31 of the ink jet head 30.

While the cleaning device 100 cleans the ink jet head 30, the cleaning liquid is continuously supplied into the cleaning bath 120, and the cleaning liquid flowing over the cleaning bath 120 is accommodated or caught in the outer bath 130 surrounding the cleaning bath 120 (e.g., in a cleaning mode or fluid circulating mode).

The cleaning liquid accommodated in the outer bath 130 is collected into or returned to the storage tank 110 through the second cleaning liquid passage 150. For this, the second cleaning liquid passage 150 has a cleaning liquid drain hole 151 that couples to the outer bath 130, and a cleaning liquid return hole 152 that couples to the storage tank 110. To effectively drain the cleaning liquid, the cleaning liquid drain hole 151 may connect to the bottom surface of the outer bath 130. The cleaning liquid return hole 152 preferably connects with the storage tank 110 at the position higher than the uppermost water level of the cleaning liquid so as not to be immersed in the cleaning liquid in the storage tank 110 but to communicate with the atmosphere.

The first cleaning liquid passage 140 and the second cleaning liquid passage 150 are configured as elongated liquid proof tubular structures such as hoses made of a flexible material, and positioned (e.g., have sufficient lengths) so as not to obstruct the movement of the cleaning bath 120 and the outer bath 130 along the carriage 186 (e.g., in the left and right directions).

As illustrated in FIG. 5, a first pumping part 160*a* is provided in the first cleaning liquid passage 140 to pump the cleaning liquid between the storage tank 110 and the cleaning bath 120, and a second pumping part 160*b* is provided in the second cleaning liquid passage 150 to pump the cleaning liquid between the outer bath 130 and the storage tank 110. This embodiment exemplifies that the first pumping part 160*a* and the second pumping part 160*b* are provided in one pump 160, however, the present general inventive concept is not intended to be so limited. For example, the first pumping part 160*a* and the second pumping part 160*b* may be respectively provided in separate pumps or devices.

The first pumping part 160*a* and the second pumping part 160*b* of the pump 160 are driven by a pumping motor 161, which can rotate in the forward and reverse directions. If the pumping motor 161 rotates in the forward direction, the first pumping part 160*a* may pump the cleaning liquid in the direction that the cleaning liquid in the storage tank 110 is supplied into the cleaning bath 120, and the second pumping part 160*b* may pump the cleaning liquid in the direction that the cleaning liquid accommodated in the outer bath 130 is collected into the storage tank 110. On the other hand, if the pumping motor 161 rotates in the reverse direction, the first pumping part 160*a* and the second pumping part 160*b* may pump the cleaning liquid in the opposite direction.

A cleaning liquid storage part 143 is provided in the first cleaning liquid passage 140 to store the cleaning liquid supplied from the storage tank 110. When the pump 160 is driven to empty or exhaust the cleaning liquid from the outer bath 130, the cleaning liquid storage part 143 may temporarily store the cleaning liquid so that the cleaning liquid pumped from the storage tank 110 does not flow into the cleaning bath 120. A more detailed explanation of operations of the cleaning device is provided below. The embodiment of FIG. 5 illustrates that an auxiliary tank 143*a* is mounted in the first cleaning liquid passage 140 as the cleaning liquid storage part 143. However, the present general inventive concept is not intended to be so limited. For example, instead of the auxiliary tank 143*a*, an expanding pipe, which can temporarily expand, or the like may be provided in the first cleaning liquid passage.

The auxiliary tank 143*a* is disposed between the pump 160 and the cleaning bath 120. The first cleaning liquid passage 140 has a first auxiliary tank connecting hole 144 and a second auxiliary tank connecting hole 145, which communicate with the auxiliary tank 143*a*. The first auxiliary tank connecting hole 144 is positioned adjacent to the bottom surface of the auxiliary tank 143*a*. The second auxiliary tank connecting hole 145 may be positioned adjacent to the top surface of the auxiliary tank 143*a* so that the cleaning liquid flowing from the storage tank 110 can be supplied to the cleaning bath 120 after filling up the auxiliary tank 143*a*.

The control unit 170 is configured to control the operation of the pump 160 or to control the operation of circulating the cleaning liquid while cleaning the ink jet head and the operation of collecting the cleaning liquid in the cleaning bath 120, the outer bath 130 and the passages 140 and 150 into the storage tank 110.

The cleaning bath 120 and the outer bath 130 are disposed at a position higher than the storage tank 110, and the pump 160 is disposed between the storage tank 110 and the cleaning bath 120.

Hereinafter, operations of embodiments of the ink jet head cleaning device according to embodiments of the present general inventive concept will be described with reference to FIGS. 3 and 6 to 9.

When the printing operation is not performed during a long period or it is determined that a clogged nozzle exists by test printing, the cleaning operation for the ink jet head may be carried on by a control program that has been inputted in advance (e.g., in the image forming apparatus) or a user's command. In one embodiment of the present general inventive concept, the cleaning operation is preferably composed of a cleaning mode and a cleaning liquid collecting mode.

Figure 6:
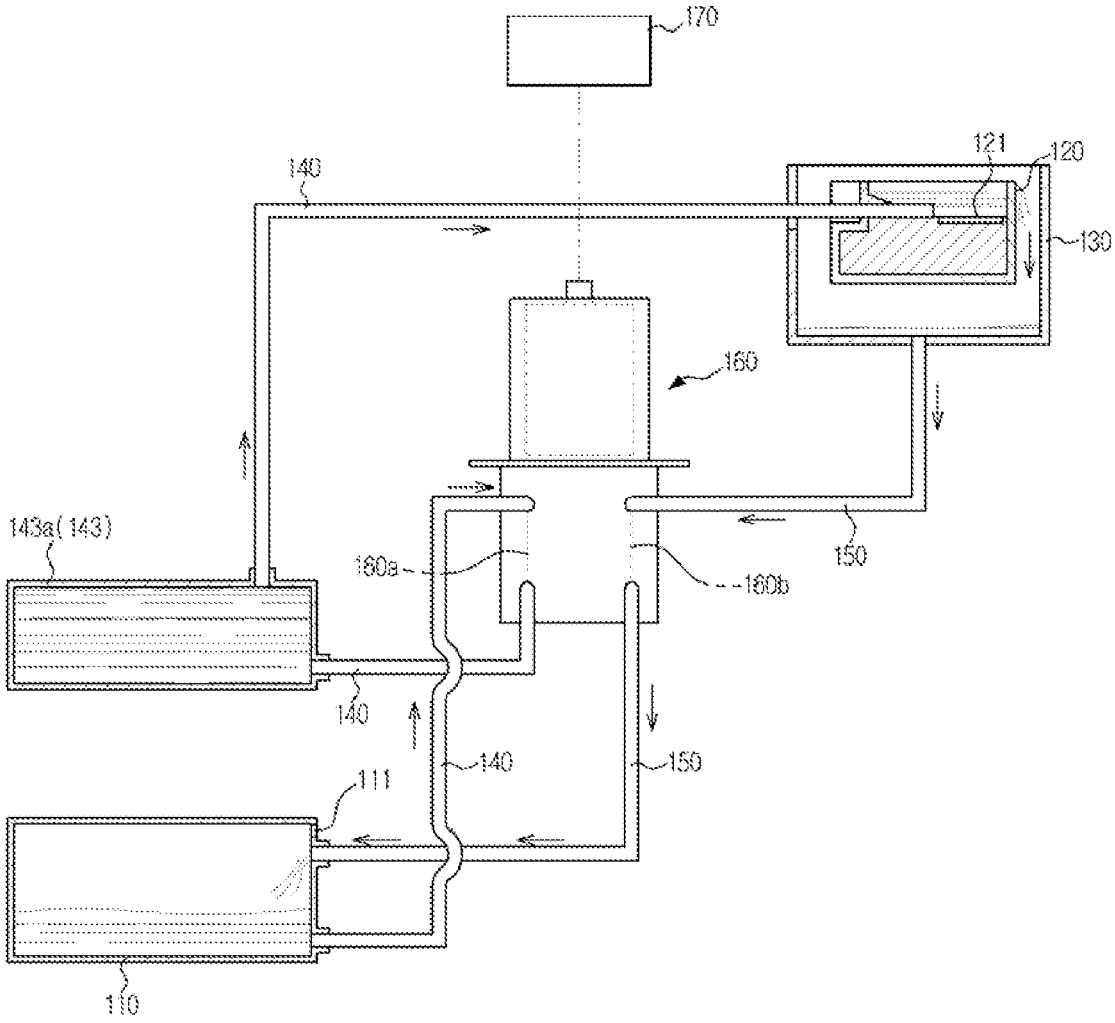
FIGS. 6 to 9 are diagrams illustrating operations of an ink jet head cleaning device in accordance with an embodiment of the present general inventive concept.

An exemplary cleaning mode will now be explained with reference to FIGS. 3 and 6. If the cleaning mode is started, the cleaning bath 120 and the outer bath 130 may be moved by the carriage 181 to be positioned below one end (e.g., the left end) of the ink jet head 30. If the movement of the cleaning bath 120 and the outer bath 130 is stopped at the cleaning position, the control unit 170 may control the pump 160 to make the first pumping part 160*a* and the second pumping part 160*b* pump the cleaning liquid in a first direction to circulate the cleaning liquid in the storage tank 110 through the first cleaning liquid passage 140 and the second cleaning liquid passage 150. For example, the cleaning liquid in the storage tank 110 is pumped by the first pumping part 160*a* to be supplied into the auxiliary tank 143*a*. After filling up the auxiliary tank 143*a*, the cleaning liquid is supplied into the cleaning bath 120 also through the first cleaning liquid passage 140. As the cleaning liquid is continuously supplied, the cleaning liquid over flows the cleaning bath 120 and is caught or accommodated in the outer bath 130. The cleaning liquid caught in the outer bath 130 may be pumped by the second pumping part 160*b* to be collected into the storage tank 110 through the second cleaning liquid passage 150.

The nozzles 33 and/or a bottom of the nozzle part 31 are spaced-apart from the ultrasonic oscillating element 121, and the cleaning liquid flow hole 142 is disposed on a plane between the nozzles 33 and the ultrasonic oscillating element 121 such that the cleaning liquid is ejected therebetween, thereby forming a liquid column therebetween.

If electric current is applied to the ultrasonic oscillating element 121 during the circulation of the cleaning liquid, a water column may be formed by the oscillation of the ultrasonic oscillating element 121, and the cleaning liquid in the cleaning bath 120 comes into contact with the nozzle part 31 of the ink jet head 30. While the water column is formed, the cleaning bath 120 is moved along (e.g., to the right) slowly by the carriage 181, and accordingly the nozzle part 31 of the array ink jet head 30 may be progressively cleaned (e.g., the nozzle plates 33 may be successively cleaned). Alternatively, the cleaning bath could be selectively positioned for each of a plurality of nozzle plates or the like.

If the cleaning mode for the ink jet head 30 is terminated, the control unit 170 may control the pump 160 to collect the cleaning liquid in the auxiliary tank 143*a*, the cleaning bath 120, the first cleaning liquid passage 140, the outer bath 130 and the second cleaning liquid passage 150 into the storage tank 110. Operations of an exemplary cleaning liquid collecting mode will now be explained with reference to FIGS. 7 to 9.

Figure 7:
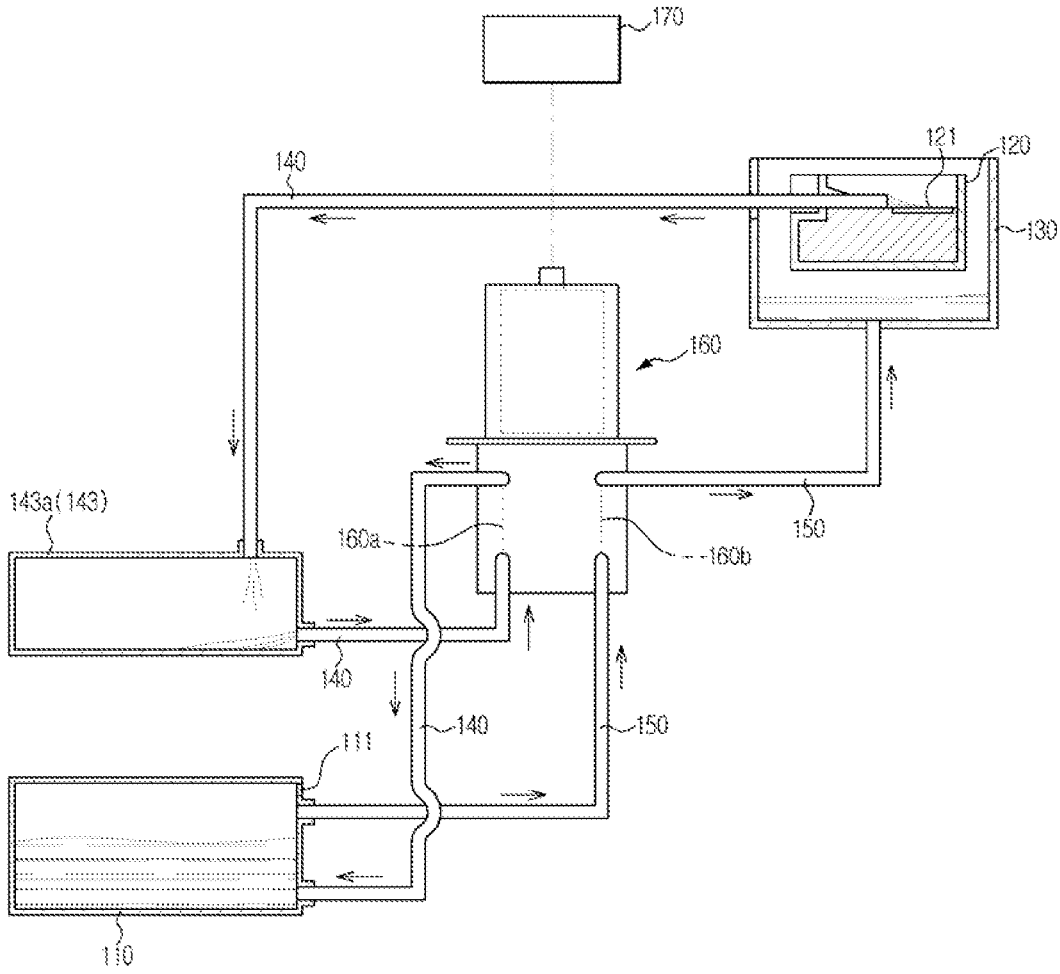
Figure 8:
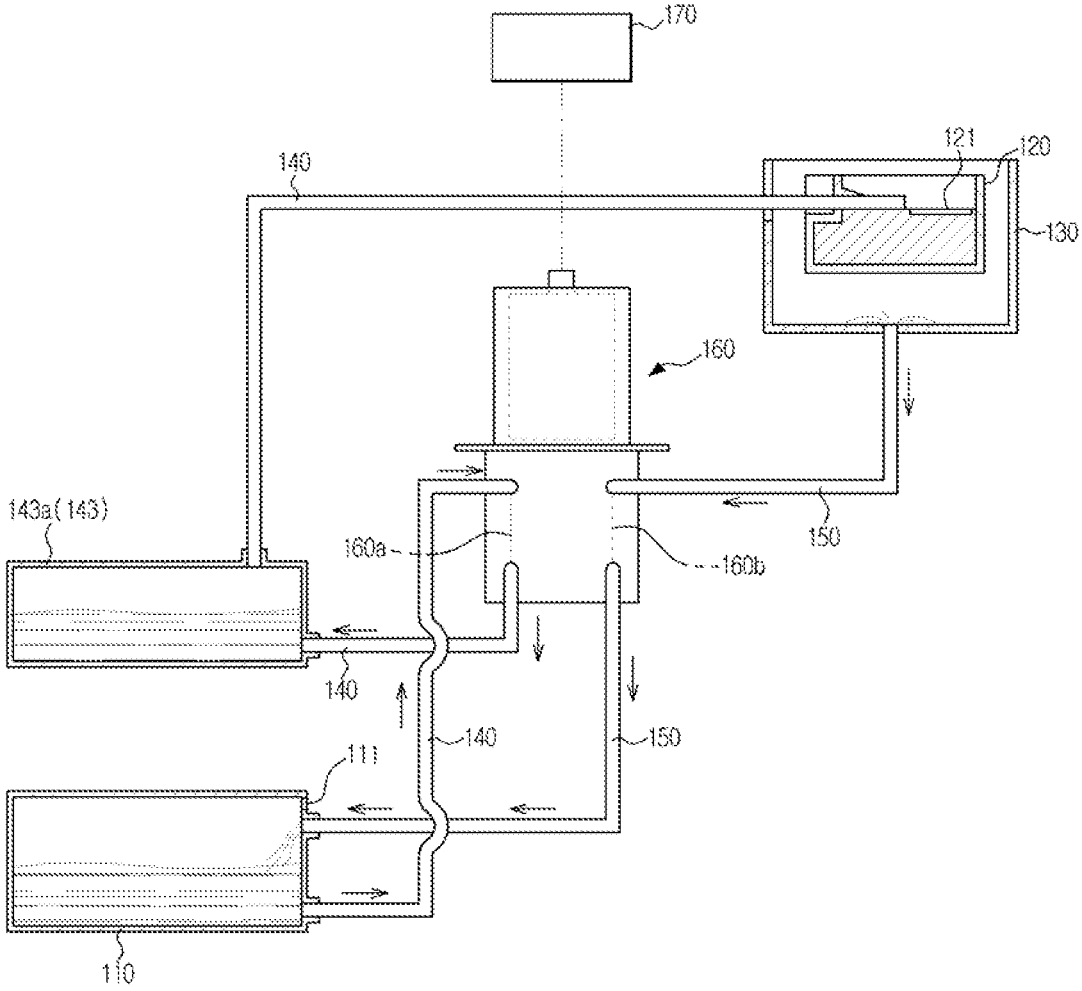
Figure 9:
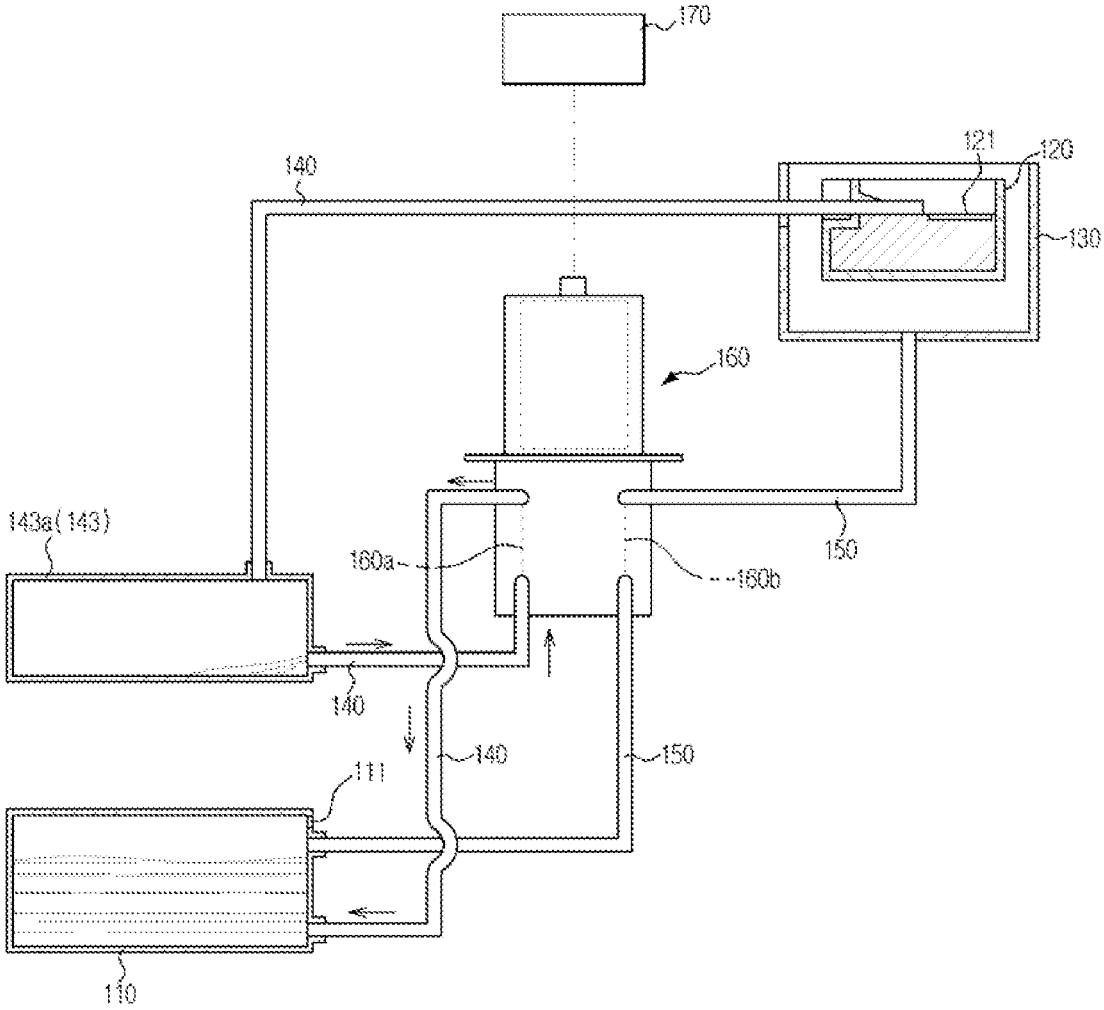

If the cleaning of the ink jet head 30 is terminated, as illustrated in FIG. 7, the cleaning liquid in the cleaning bath 120 and the auxiliary tank 143*a* may be collected (first cleaning liquid collecting mode). The control unit 170 preferably controls the pump 160 to make the first pumping part 160*a* and the second pumping part 160*b* pump the cleaning liquid in a second direction. In this case, the second direction refers to a direction opposite to the aforesaid first direction. If the first pumping part 160*a* of the pump 160 pumps the cleaning liquid in the second direction, the cleaning liquid filled in the cleaning bath 120, the auxiliary tank 143*a* and the first cleaning liquid passage 140 can flow backward and collect into the storage tank 110. Also, as the second pumping part 160*b* of the pump 160 pumps the cleaning liquid in the second direction, the cleaning liquid in the second cleaning liquid passage 150 can flow backward, and flow into the outer bath 130. At this time, because the cleaning liquid return hole 152 of the second cleaning liquid passage 150 is exposed to the atmosphere, if the cleaning liquid in the second cleaning liquid passage 150 flows totally into the outer bath 130, and air can flow through the second cleaning liquid passage 150.

If the first cleaning liquid collecting mode as described above is terminated, as illustrated in FIG. 8, a second cleaning liquid collecting mode may collect the cleaning liquid that has flowed into the outer bath 130. In the second cleaning liquid collecting mode, the control unit 170 preferably controls the pump 160 to make the first pumping part 160*a* and the second pumping part 160*b* pump the cleaning liquid again in the first direction. If the second pumping part 160*b* of the pump 160 pumps the cleaning liquid in the first direction, the cleaning liquid in the outer bath 130 may be collected into the storage tank 110 through the second cleaning liquid passage 150. Also, as the first pumping part 160*a* of the pump 160 is also pumping the cleaning liquid in the first direction, the cleaning liquid (e.g., a predetermined amount) in the storage tank 110 may be supplied into the auxiliary tank 143*a* and stored therein. The auxiliary tank 143*a* may temporarily store the cleaning liquid so that the cleaning liquid pumped from the storage tank 110 does not flow into the cleaning bath 120. At this time, the control unit 170 preferably controls the operating time and/or speed of the pump 160 so that the cleaning liquid does not arrive at the cleaning bath 120 via the auxiliary tank 143*a*.

If the second cleaning liquid collecting mode as described above is terminated, a third cleaning liquid collecting mode may collect the cleaning liquid stored in the auxiliary tank 143*a*. In the third cleaning liquid collecting mode, the control unit 170 preferably controls the pump 160 to make the first pumping part 160*a* and the second pumping part 160*b* pump the cleaning liquid again in the second direction. The cleaning liquid in the auxiliary tank 143*a* may then be finally collected into the storage tank 110 through the first cleaning liquid passage 140, and the cleaning liquid collecting operation may terminate. At this time, the pumping force is also applied to the second cleaning liquid passage 150 by the second pumping part 160*b*. However, because the cleaning liquid does not exist in the outer bath 130 and the first cleaning liquid passage 140, air flows to the outer bath 130 from the storage tank 110.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

As described above, embodiments of an ink jet image forming apparatus, an ink jet head cleaning device and methods thereof according to the present general inventive concept can substantially totally or totally collect cleaning liquid from circulation passages, cleaning baths and the like after a cleaning operation for the print head. Accordingly, embodiments of the present general inventive concept can prevent or reduced a problem in safety or a loss of the cleaning liquid caused by the residual cleaning liquid in the cleaning device (e.g., cleaning bath or in the passage).

Further, since the cleaning device of the present general inventive concept in one embodiment is constituted such that the cleaning bath can move along the ink jet head, the cleaning liquid can be substantially totally collected or totally collected even when the circulation passage is long. Accordingly, the cleaning device of the present general inventive concept may adequately clean the array ink jet head.

Still further, since embodiments of the cleaning device of the present general inventive concept can circulate the cleaning liquid simultaneously while moving the cleaning bath, it can clean the array ink jet head with a reduced or minimum cleaning liquid, and/or can be manufactured compactly.

Although a few embodiments of the present general inventive concept have been illustrated and described, it would be appreciated by those skilled in the art that changes may be made in these embodiments without departing from the principles and spirit of the present general inventive concept, the scope of which is defined in the claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transitional terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An ink jet image forming apparatus comprising:

an ink jet head; and a cleaning device to clean the ink jet head, the cleaning device comprises:

a storage tank to store a cleaning liquid;

a cleaning bath that is supplied with the cleaning liquid from the storage tank and in which an oscillating element is mounted;

an outer bath to accommodate the cleaning liquid flowing over the cleaning bath;

a first cleaning liquid passage to connect the storage tank and the cleaning bath;

a second cleaning liquid passage to connect the outer bath and the storage tank;

a first pumping part provided in the first cleaning liquid passage; and a second pumping part provided in the second cleaning liquid passage.

2. The ink jet image forming apparatus according to claim 1, wherein the first pumping part is capable of bidirectional pumping.

3. The ink jet image forming apparatus according to claim 1, wherein the cleaning device further includes an auxiliary tank mounted in the first cleaning liquid passage to store the cleaning liquid pumped from the storage tank.

4. The ink jet image forming apparatus according to claim 1, wherein the first pumping part and the second pumping part are driven by one pumping motor.

5. The ink jet image forming apparatus according to claim 1, wherein the second cleaning liquid passage has a cleaning liquid return hole connected with the storage tank at a position higher than an uppermost level of the cleaning liquid stored in the storage tank.

6. The ink jet image forming apparatus according to claim 1, wherein the second cleaning liquid passage has a cleaning liquid drain hole connected with the outer bath at a position adjacent to a bottom surface of the outer bath.

7. The ink jet image forming apparatus according to claim 1, wherein the storage tank has an atmosphere communication hole to be kept at an atmospheric pressure.

8. The ink jet image forming apparatus according to claim 1, wherein:

the cleaning device further includes an auxiliary tank mounted in the first cleaning liquid passage to store the cleaning liquid pumped from the storage tank, wherein the first cleaning liquid passage has a first auxiliary tank connecting hole and a second auxiliary tank connecting hole, the first auxiliary tank connecting hole communicates with the auxiliary tank at a position adjacent to a bottom surface of the auxiliary tank; and the second auxiliary tank connecting hole communicates with the auxiliary tank at a position adjacent to a top surface of the auxiliary tank so that the cleaning liquid pumped from the storage tank can be supplied to the cleaning bath after filling up the auxiliary tank.

9. The ink jet image forming apparatus according to claim 1, wherein the ink jet head includes an array ink jet head that has a nozzle part having a length corresponding to a width of a printing medium.

10. The ink jet image forming apparatus according to claim 9, wherein:

the first cleaning liquid passage and the second cleaning liquid passage are made of a flexible material; and the cleaning bath and the outer bath are mounted movably along a width direction of the array ink jet head.

11. The ink jet image forming apparatus according to claim 1, further comprising:

a control unit to control operations of the first pumping part and the second pumping part, wherein the control unit includes a cleaning mode to control the first pumping part and the second pumping part to pump the cleaning liquid in a first direction to supply the cleaning liquid in the storage tank to the cleaning bath and collect the cleaning liquid in the outer bath into the storage tank.

12. The ink jet image forming apparatus according to claim 11, wherein the control unit further includes a first cleaning liquid collecting mode to control the first pumping part and the second pumping part to pump the cleaning liquid in a second direction to collect the cleaning liquid in the cleaning bath into the storage tank and send the cleaning liquid in the second cleaning liquid passage into the outer bath.

13. The ink jet image forming apparatus according to claim 12, wherein the control unit further includes a second cleaning liquid collecting mode to control the first pumping part and the second pumping part to pump the cleaning liquid in the first direction to collect the cleaning liquid in the outer bath into the storage tank.

14. The ink jet image forming apparatus according to claim 13, wherein the control unit further includes a third cleaning liquid collecting mode to control the first pumping part and the second pumping part to pump the cleaning liquid in the second direction to collect the cleaning liquid in the first cleaning liquid passage into the storage tank.

15. An ink jet head cleaning device usable with an image forming apparatus to clean an ink jet head, comprising:

a storage tank to store a cleaning liquid;

a cleaning bath that has an opened upper portion and in which an oscillating element is mounted;

an outer bath to accommodate the cleaning liquid flowing over the cleaning bath;

a first cleaning liquid passage to connect the storage tank and the cleaning bath;

a second cleaning liquid passage to connect the outer bath and the storage tank; and a pump mounted in the first cleaning liquid passage and the second cleaning liquid passage.

16. The ink jet head cleaning device according to claim 15, further comprising:

an auxiliary tank mounted in the first claiming liquid passage to store the cleaning liquid supplied from the storage tank.

17. The ink jet head cleaning device according to claim 15, further comprising:

a control unit to control an operation of the pump and to perform a cleaning mode to control the pump to pump the cleaning liquid in a first direction to circulate the cleaning liquid in the storage tank through the first cleaning liquid passage, the cleaning bath, the outer bath and the second cleaning liquid passage.

18. The ink jet head cleaning device according to claim 17, wherein the control unit further includes a first cleaning liquid collecting mode to control the pump to pump the cleaning liquid in a second direction to collect the cleaning liquid in the cleaning bath and the first cleaning liquid passage into the storage tank and send the cleaning liquid in the second cleaning liquid passage into the outer bath.

19. The ink jet head cleaning device according to claim 18, wherein the control unit further includes a second cleaning liquid collecting mode to control the pump to pump the cleaning liquid in the first direction to collect the cleaning liquid in the outer bath into the storage tank and send the cleaning liquid in the storage tank into the cleaning liquid storage part.

20. The ink jet head cleaning device according to claim 19, wherein the control unit further includes a third cleaning liquid collecting mode to control the pump to pump the cleaning liquid in the second direction to collect the cleaning liquid in the cleaning liquid storage part into the storage tank.

21. An ink jet head cleaning device usable with an image forming apparatus comprising:

a storage tank to store a cleaning liquid;

a bath having an oscillating element to generate a liquid stream from the cleaning liquid; and a pump connected between the storage tank and the bath to circulate the cleaning liquid between the storage bath and the storage tank, wherein the pump pumps the cleaning liquid in a first direction between storage unit and the bath and in a second direction between the storage tank and the bath.

* * * * *